US010639896B2

(12) United States Patent
Suwada

(10) Patent No.: US 10,639,896 B2
(45) Date of Patent: May 5, 2020

(54) PRINTING APPARATUS

(71) Applicant: Roland DG Corporation, Hamamatsu-shi, Shizuoka (JP)

(72) Inventor: Akira Suwada, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 5 days.

(21) Appl. No.: 16/125,806

(22) Filed: Sep. 10, 2018

(65) Prior Publication Data

US 2019/0077157 A1 Mar. 14, 2019

(30) Foreign Application Priority Data

Sep. 11, 2017 (JP) ..... 2017-173969

(51) Int. Cl.
*B41J 2/165* (2006.01)

(52) U.S. Cl.
CPC ..... *B41J 2/16508* (2013.01); *B41J 2/16511* (2013.01); *B41J 2/16532* (2013.01); *B41J 2002/16576* (2013.01)

(58) Field of Classification Search
CPC ..... B41J 2/16505; B41J 2/16511; B41J 2/16532; B41J 2/16517; B41J 2/16585; B41J 2/165; B41J 2/16547; B41J 2/16508
See application file for complete search history.

(56) References Cited

U.S. PATENT DOCUMENTS 6,481,826 B1 * 11/2002 Hara et al. ..... 347/29
2002/0158939 A1 10/2002 Shima

FOREIGN PATENT DOCUMENTS

JP 2002-326366 A 11/2002

* cited by examiner

*Primary Examiner* — Juanita D Jackson
(74) *Attorney, Agent, or Firm* — Keating & Bennett, LLP

(57) ABSTRACT

A printing apparatus includes an ink head, a carriage, and a cap. The ink head includes a nozzle surface provided with a nozzle to discharge ink onto a recording medium. The carriage is equipped with the ink head, and disposed above a platen. The carriage is movable in a main scanning direction. The cap defines an enclosed space between the cap and the nozzle surface when the cap is attached to the ink head. The carriage includes a facing surface facing the platen and a guard provided on the facing surface to protrude downward. The guard is provided with a reference surface that positions the ink head and the cap relative to each other.

8 Claims, 9 Drawing Sheets

PRINTING APPARATUS

CROSS REFERENCE TO RELATED APPLICATIONS

This application claims the benefit of priority to Japanese Patent Application No. 2017-173969 filed on Sep. 11, 2017. The entire contents of this application are hereby incorporated herein by reference.

BACKGROUND OF THE INVENTION

1. Field of the Invention

The present invention relates to printing apparatuses.

2. Description of the Related Art

Examples of printing apparatuses known in the related art include an inkjet printer. A common inkjet printer includes an ink head including a nozzle to discharge ink onto a recording medium, a carriage to move the ink head in a main scanning direction, and a conveyor to convey the recording medium in a sub-scanning direction (i.e., a conveyance direction). Such an inkjet printer repeats conveyance of the recording medium and movement of the ink head in an alternating manner so as to print an image on the recording medium.

The inkjet printer may encounter a situation where foreign matter adheres to a nozzle surface provided with the nozzle and/or the nozzle is clogged with foreign matter, resulting in defective ink discharge. One approach to preventing such defective discharge is to perform cleaning that involves performing suitable positioning of a cap unit equipped with a cap relative to the carriage equipped with the ink head, covering the nozzle surface with the cap, with the cap unit suitably positioned relative to the carriage, and sucking, using a suction pump, for example, a fluid (e.g., ink or air) within an enclosed space defined between the nozzle surface and the cap. This cleaning changes the nozzle back to normal. Such an approach makes it necessary to suck the fluid within the enclosed space, with the nozzle surface securely covered with the cap (see JP 2002-326366 A, for example).

To define the enclosed space between the cap and the nozzle surface provided on the ink head, positioning of the ink head and the cap relative to each other needs to be accurately performed during assembly of a printing apparatus. Unfortunately, no reference portion (e.g., a reference surface) for such positioning is clearly defined in printing apparatuses known in the related art. For example, defining a clear reference portion for positioning on a lower surface of the carriage facing the cap is effective in performing accurate positioning. The lower surface of the carriage, however, is provided with various components. This limits a space where the reference portion is to be defined. Defining the reference portion entails an increase in the number of components. This unfavorably results in an increase in manufacturing cost.

SUMMARY OF THE INVENTION

Accordingly, preferred embodiments of the present invention provide printing apparatuses that each enable accurate positioning of an ink head and a cap relative to each other while reducing or minimizing the number of components to define a reference portion in a space on a lower surface of a carriage.

A printing apparatus according to a preferred embodiment of the present invention includes a platen, a conveyor, an ink head, a carriage, a cap, and a suction device. A recording medium is to be placed on the platen. The platen extends in a main scanning direction. The conveyor conveys the recording medium in a sub-scanning direction perpendicular or substantially perpendicular to the main scanning direction. The ink head includes a nozzle and a nozzle surface. The nozzle discharges ink onto the recording medium. The nozzle surface is provided with the nozzle. The carriage is equipped with the ink head. The carriage is disposed above the platen. The carriage is movable in the main scanning direction. The cap is detachably attachable to the ink head so as to cover the nozzle surface. The cap defines an enclosed space between the cap and the nozzle surface when the cap is attached to the ink head. The suction device sucks a fluid within the enclosed space. The carriage includes a facing surface and a guard. The facing surface faces the platen. The guard is provided on the facing surface. The guard protrudes downward. The guard is provided with a reference surface that positions the ink head and the cap relative to each other.

The other features of preferred embodiments of the present invention will be apparent from the following detailed description thereof.

Preferred embodiments of the present invention provide printing apparatuses that each enable accurate positioning of an ink head and a cap relative to each other while reducing or minimizing the number of components to define a reference portion in a space on a lower surface of a carriage.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Printing apparatuses according to preferred embodiments of the present invention will be described below with reference to the drawings. The preferred embodiments described below are naturally not intended to limit the present invention in any way. Components and elements having the same functions are identified by the same reference signs, and description thereof will be simplified or omitted when deemed redundant.

First Preferred Embodiment

Figure 1A:
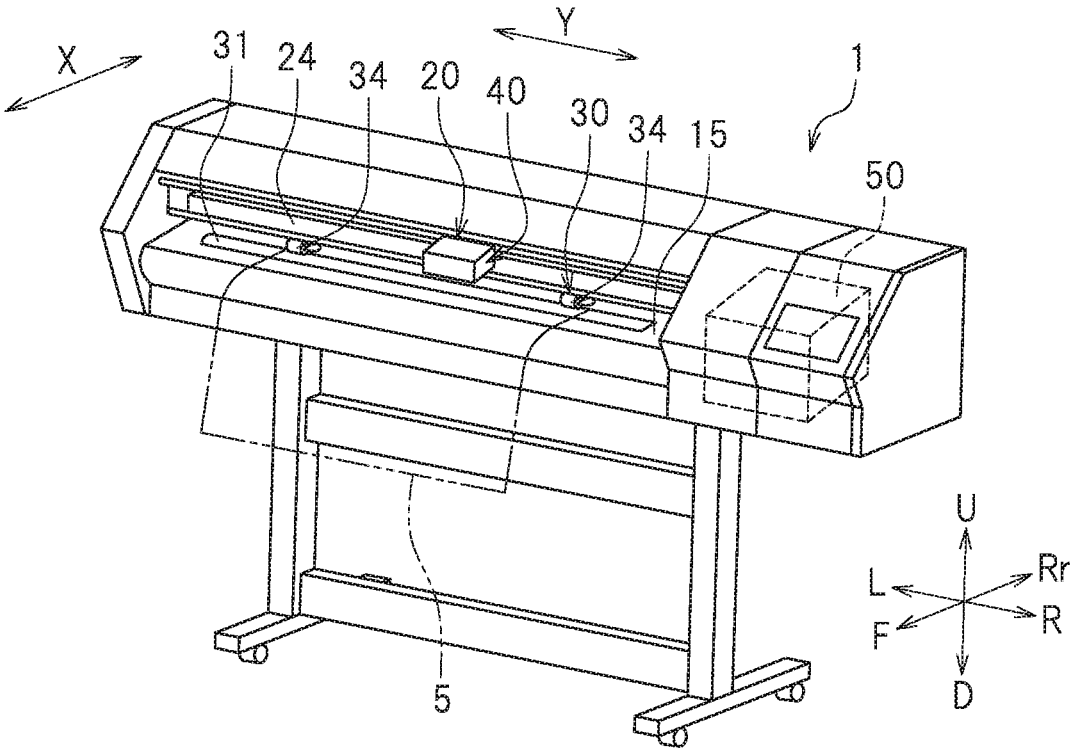
FIG. 1A is a schematic diagram illustrating an outer appearance of a printing apparatus according to a first preferred embodiment of the present invention.

FIG. 1A is a perspective view of a printing apparatus 1 according to a first preferred embodiment of the present invention. As illustrated in FIG. 1A, the printing apparatus 1 performs printing on a recording medium 5. In one example, the printing apparatus 1 is an inkjet printer. In one example, the recording medium 5 is recording paper. The recording medium 5 is not limited to recording paper. The recording medium 5 may be any type of paper, such as plain paper or inkjet printing paper. The recording medium 5 may be any medium other than paper. The recording medium 5 may be a resin sheet or film made of polyvinyl chloride or polyester, for example, or may be a fabric, such as a woven fabric or a nonwoven fabric.

In the following description, the terms "right", "left", "up", and "down" respectively refer to right, left, up, and down with respect to an operator facing the front of the printing apparatus 1. A direction from the rear of the printing apparatus 1 toward the operator is a forward direction. A direction from the operator toward the rear of the printing apparatus 1 is a rearward direction. The reference signs F, Rr, R, L, U, and D in the drawings respectively represent front, rear, right, left, up, and down. The reference sign Y in the drawings represents a main scanning direction. In the present preferred embodiment, the main scanning direction Y is a right-left direction. The main scanning direction Y corresponds to the width direction of the recording medium 5. The reference sign X in the drawings represents a sub-scanning direction (i.e., a conveyance direction). The sub-scanning direction X is a direction intersecting the main scanning direction Y. In one example, the sub-scanning direction X is a direction perpendicularly intersecting the main scanning direction Y in a plan view. In the present preferred embodiment, the sub-scanning direction X is a front-rear direction. The sub-scanning direction X corresponds to the longitudinal direction of the recording medium 5. As used herein, the term "downstream" refers to being located adjacent to the front of the printing apparatus 1, and the term "upstream" refers to being located adjacent to the rear of the printing apparatus 1. These directions are defined merely for the sake of convenience of description and should not be construed as limiting the present invention.

As illustrated in FIG. 1A, the printing apparatus 1 includes a controller 10 (see FIG. 1B), a platen 15, a carriage unit 20, a conveyor 30, a printing unit 40, and a cap unit 50.

Figure 1B:
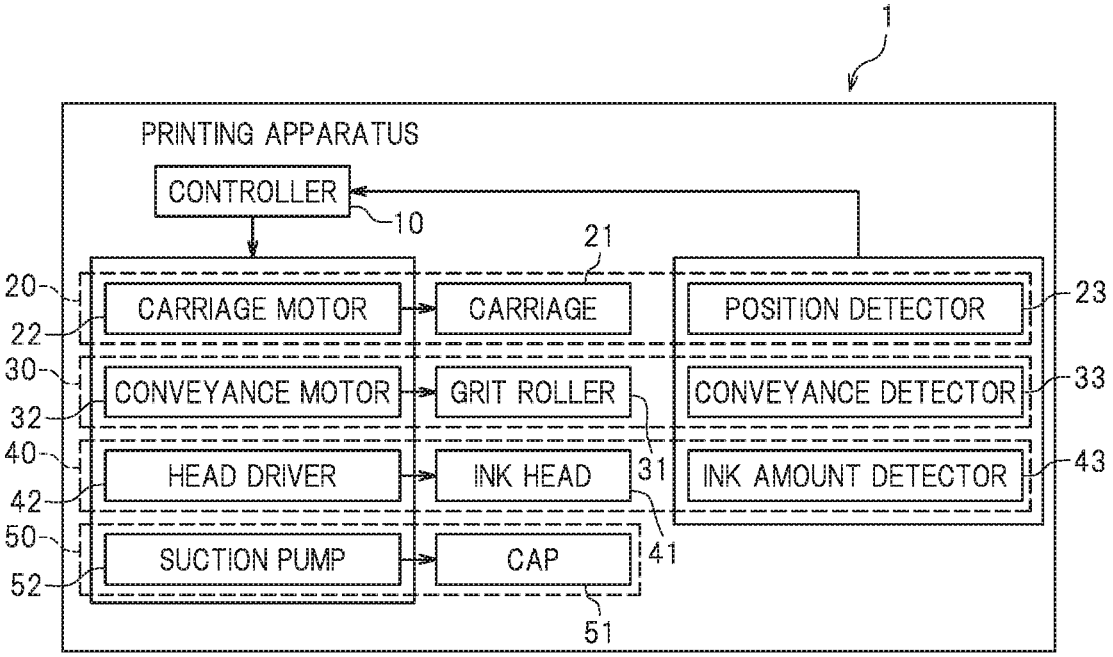
FIG. 1B is a block diagram of the printing apparatus according to the first preferred embodiment of the present invention.

As illustrated in FIG. 1B, the controller 10 is configured or programmed to control operations of the printing apparatus 1. In accordance with a printing command from an external computer, the controller 10 controls components of the printing apparatus 1, such as a carriage motor 22, a conveyance motor 32, a head driver 42, and a suction pump 52. The controller 10 performs feedback control in accordance with detection results obtained by a position detector 23, a conveyance detector 33, and an ink amount detector 43.

As illustrated in FIG. 1A, the platen 15 extends in the main scanning direction Y. The recording medium 5 is placed on the platen 15.

As illustrated in FIG. 1B, the carriage unit 20 includes a carriage 21 and the carriage motor 22. The carriage 21 moves in the main scanning direction Y in a reciprocating manner. The carriage 21 is disposed above the platen 15. The carriage 21 is equipped with ink heads 41. The reciprocating movement of the carriage 21 in the main scanning direction Y causes the ink heads 41 to move in the main scanning direction Y in a reciprocating manner. The carriage motor 22 is a driver that moves the carriage 21 in the main scanning direction Y. The carriage unit 20 further includes the position detector 23 to detect the position of the carriage 21 in the main scanning direction Y.

Figure 2:
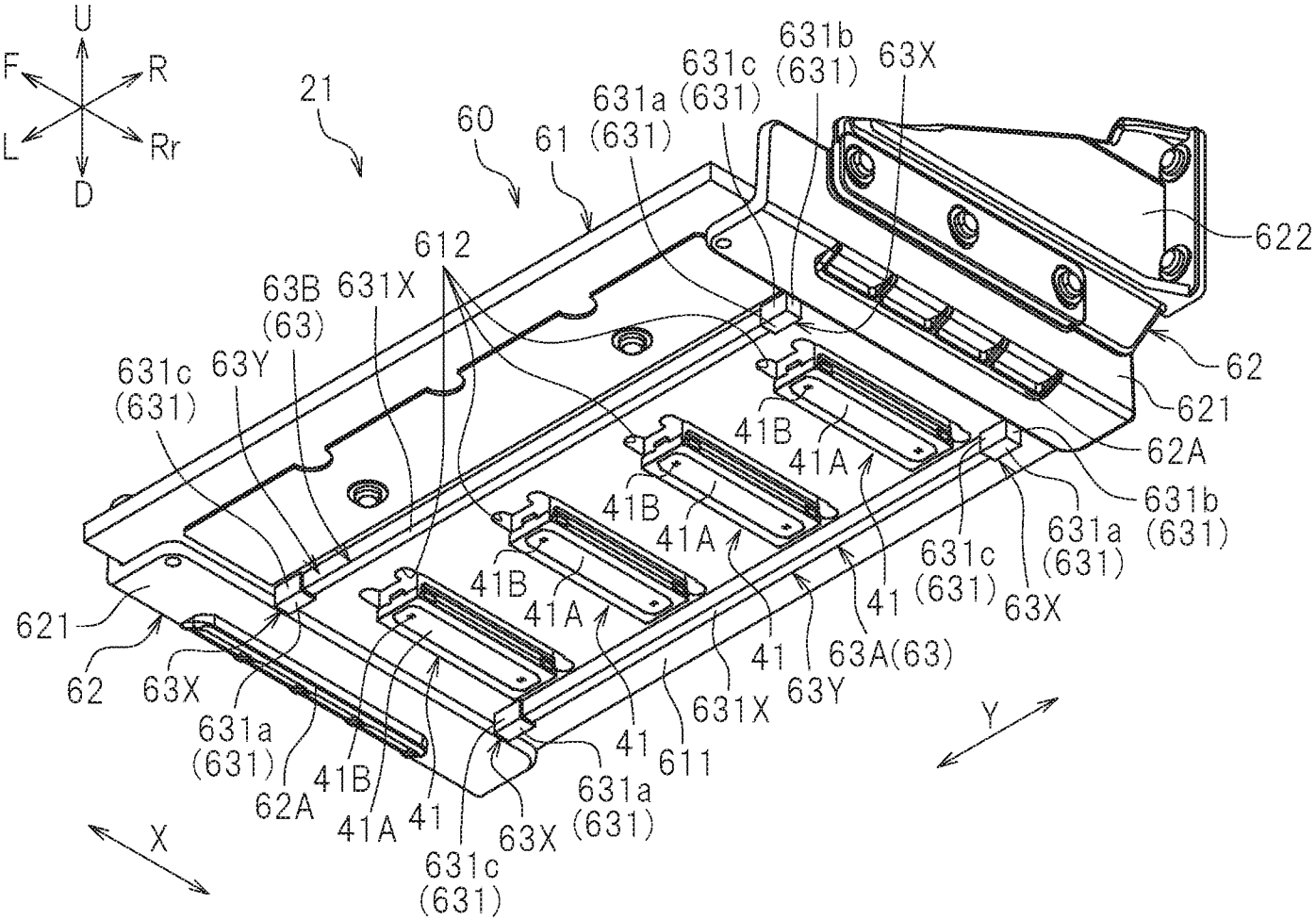
FIG. 2 is a perspective view of a carriage and ink heads according to the first preferred embodiment of the present invention.

As illustrated in FIG. 2, the carriage 21 includes a frame 60 secured to a driving belt (not illustrated). Running of the driving belt moves the carriage 21 along a guide rail 24 (see FIG. 1A) extending in the main scanning direction Y. The ink heads 41 are attached to the frame 60. The frame 60 includes a head-equipped frame 61 and a pair of securing frames 62.

The head-equipped frame 61 is equipped with the ink heads 41. The head-equipped frame 61 is a flat plate member. The head-equipped frame 61 includes a facing surface 611 that faces the recording medium 5 (see FIG. 1A). The facing surface 611 corresponds to the lower surface of the head-equipped frame 61. The facing surface 611 faces the platen 15.

The facing surface 611 of the head-equipped frame 61 is provided with openings 612. The lower portion of each ink head is inserted through an associated one of the openings 612. Thus, the ink heads 41 are protruded downward from the facing surface 611 of the head-equipped frame 61 such that nozzle surfaces 41A of the ink heads 41 are located below the facing surface 611.

Components associated with the ink heads 41 are attached to the head-equipped frame 61. In one example, an electronic component, such as an integrated circuit, and an electromechanical component to secure the electronic component to the head-equipped frame 61, for example, are attached to a surface of the head-equipped frame 61 opposite to the facing surface 611. The surface of the head-equipped frame 61 opposite to the facing surface 611 is the upper surface of the head-equipped frame 61.

The facing surface 611 of the head-equipped frame 61 is provided with a guard 63 protruding downward from the facing surface 611. In the present preferred embodiment, the guard 63 is provided at two locations on the facing surface 611. Specifically, the guard 63 includes a first guard 63A and a second guard 63B. The first guard 63A and the second guard 63B extend in the main scanning direction Y. The first guard 63A is disposed upstream of the ink heads 41 in the sub-scanning direction X. The second guard 63B is disposed downstream of the ink heads 41 in the sub-scanning direction X. In the following description, the term "guard 63" is used to refer to both of the first guard 63A and the second guard 63B when no distinction is made therebetween. The guard 63 is provided on the facing surface 611 such that the guard 63 is integral with the head-equipped frame 61. The guard 63 may be a component that is separate from the head-equipped frame 61 and is to be attached to the head-equipped frame 61.

The guard 63 protects the ink heads 41 in the event of a jam (i.e., a paper jam). The first guard 63A and the second guard 63B surround the ink heads 41 in the sub-scanning direction X. Specifically, when viewed from the downstream side in the sub-scanning direction X, the guard 63 is disposed such that a region where the guard 63 is located overlaps with a region where the ink heads 41 are located (i.e., portions of the ink heads 41 extending in the main scanning direction Y). This prevents the recording medium 5 from not only coming closer to the ink heads 41 from the upstream side or the downstream side in the sub-scanning direction X but also coming closer to the ink heads 41 in the main scanning direction Y in the event of a jam. In other words, the guard 63 defines and functions as a barrier to prevent the recording medium 5 from coming into contact with the ink heads 41 in the event of a jam.

In terms of preventing the recording medium 5 from coming closer to the ink heads 41 from the downstream side in the sub-scanning direction X in the event of a jam, the height of the guard 63 (i.e., the length of protrusion of the guard 63 from the facing surface 611) is preferably equal to or longer than a distance between the facing surface 611 of the carriage 21 and the nozzle surface 41A of each ink head 41 protruded from the facing surface 611 toward the recording medium 5.

The guard 63 is provided with reference surfaces 631 used to position the head-equipped frame 61 and a cap-equipped frame 542 (see FIG. 3) relative to each other during assembly of the printing apparatus 1. In other words, the reference surfaces 631 are used to position of each ink head 41 and an associated one of caps 51 of the cap unit 50 relative to each other. Such positioning is performed to cause the nozzle surface 41A of each ink head 41 and the associated cap 51 to face each other and cause the nozzle surface 41A of each ink head 41 to be in abutment with the associated cap 51 at an appropriate pressure during cleaning of the ink heads 41.

In the present preferred embodiment, the both ends of the first guard 63A and the both ends of the second guard 63B in the main scanning direction Y are each provided with an associated one of the reference surfaces 631. Each reference surface 631 includes a vertical direction reference surface 631*a*, a main scanning direction reference surface 631*b*, and sub-scanning direction reference surfaces 631*c*. The reference surface 631 on each of the ends of the guard 63 in the main scanning direction Y is provided such that the vertical direction reference surface 631*a*, the main scanning direction reference surface 631*b*, and the sub-scanning direction reference surfaces 631*c* are adjacent to each other. Each reference surface 631 is provided such that the vertical direction reference surface 631*a*, the main scanning direction reference surface 631*b*, and the sub-scanning direction reference surfaces 631*c* are perpendicular or substantially perpendicular to each other. Thus, the orientation and angle of each vertical direction reference surface 631*a* correspond to the orientation and angle of the ink heads 41 when the ink heads 41 move in a vertical direction, the orientation and angle of each main scanning direction reference surface 631*b* correspond to the orientation and angle of the ink heads 41 when the ink heads 41 move in the main scanning direction Y, and the orientation and angle of each sub-scanning direction reference surface 631*c* correspond to the orientation and angle of the ink heads 41 when the ink heads 41 move in the sub-scanning direction X. This enables reliable positioning of the head-equipped frame 61 and the cap-equipped frame 542 relative to each other, i.e., reliable positioning of each ink head 41 and the associated cap 51 relative to each other.

The vertical direction reference surfaces 631*a* are provided to position each ink head 41 and the associated cap 51 relative to each other in the vertical direction. Each vertical direction reference surface 631*a* is a flat surface perpendicular or substantially perpendicular to the vertical direction. The number of locations on the facing surface 611 where the vertical direction reference surfaces 631*a* are provided is four in total, for example. The vertical direction reference surfaces 631*a* are located below an additional surface 631*x* of the guard 63. In other words, the vertical direction reference surfaces 631*a* are located farther away from the facing surface 611 than the additional surface 631*x* of the guard 63. The additional surface 631*x* is located above the vertical direction reference surfaces 631*a*. The guard 63 includes a first portion 63X where the reference surface 631 is located, and a second portion 63Y located laterally of the first portion 63X. The length of each vertical direction reference surface 631*a* in the sub-scanning direction X is longer than the length of the second portion 63Y in the sub-scanning direction X.

The main scanning direction reference surfaces 631*b* are provided to position each ink head 41 and the associated cap 51 relative to each other in the main scanning direction Y. Each main scanning direction reference surface 631*b* is a flat surface perpendicular or substantially perpendicular to the main scanning direction Y. The main scanning direction reference surfaces 631*b* are provided on the both ends of the first guard 63A and the both ends of the second guard 63B in the main scanning direction Y. Thus, the number of locations on the facing surface 611 where the main scanning direction reference surfaces 631*b* are provided is four in total, for example.

The sub-scanning direction reference surfaces 631*c* are provided to position each ink head 41 and the associated cap 51 relative to each other in the sub-scanning direction X. Each sub-scanning direction reference surface 631*c* is a flat surface perpendicular or substantially perpendicular to the sub-scanning direction X. The sub-scanning direction reference surfaces 631*c* are provided at two locations on each of the ends of the first guard 63A and the ends of the second guard 63B, for example. Specifically, the sub-scanning direction reference surfaces 631*c* provided on the both ends of the first guard 63A and the both ends of the second guard 63B are disposed on the upstream side and the downstream side in the sub-scanning direction X. Thus, the number of locations on the facing surface 611 where the sub-scanning direction reference surfaces 631*c* are provided is eight in total, for example.

The use of the main scanning direction reference surfaces 631*b* and the sub-scanning direction reference surfaces 631*c* enables positioning of each ink head 41 and the associated cap 51 relative to each other in a horizontal direction. As used herein, the term "horizontal direction" includes the main scanning direction Y and the sub-scanning direction X. Although described in detail below, all of the main scanning direction reference surfaces 631*b* provided at four locations and the sub-scanning direction reference surfaces 631*c* provided at eight locations do not necessarily have to be used for such horizontal positioning.

A particularly important consideration in performing positioning of each ink head 41 and the associated cap 51 relative to each other is to make adjustments such that the nozzle surface 41A of each ink head 41 and the associated cap 51 face each other and the nozzle surface 41A of each ink head 41 is in abutment with the associated cap 51 at an appropriate pressure. Thus, the reference surfaces 631 are preferably disposed as close as possible to the ink heads 41. Because the reference surfaces 631 are provided on the guard 63 in the present preferred embodiment, the guard 63 itself is preferably disposed as close as possible to the ink heads 41.

In the present preferred embodiment, the head-equipped frame 61 is a metal member provided by die casting. After the metal member is provided by die casting, the reference surfaces 631 are provided by cutting the metal member. The reference surfaces 631 perform positioning as previously described. Accordingly, the reference surfaces 631 are preferably as flat as possible. Providing the reference surfaces 631 by cutting results in surfaces that are flatter than surfaces provided by die casting. As previously mentioned, the vertical direction reference surfaces 631*a* are disposed below the additional surface 631*x* of the guard 63 such that the vertical direction reference surfaces 631*a* are located farther away from the facing surface 611 than the additional surface 631*x*. Thus, the vertical direction reference surfaces 631*a* are provided by cutting only portions of the metal member located below the additional surface 631*x*. This reduces the number of machining steps.

As illustrated in FIG. 2, each securing frame 62 secures the head-equipped frame 61 to the driving belt (not illustrated). The head-equipped frame 61 is interposed between the securing frames 62 in the main scanning direction Y. Each securing frame 62 includes two members, i.e., a first securing frame 621 and a second securing frame 622. Each first securing frame 621 is an L-shaped member attached to the head-equipped frame 61. The lower surface of each L-shaped first securing frame 621 serves as a facing surface that faces the recording medium 5. Each second securing frame 622 is secured to the driving belt (not illustrated) such that the associated first securing frame 621 is secured to the driving belt. Each securing frame 62 may consist of a single member or may include three or more members, for example.

The lower surface of each first securing frame 621 is provided with a third guard 62A. Each third guard 62A protects the ink heads 41 in the event of a jam. Each third guard 62A is protruded toward the recording medium 5. One of the third guards 62A is disposed rightward of the ink heads 41 in the main scanning direction Y, and the other third guard 62A is disposed leftward of the ink heads 41 in the main scanning direction Y. In other words, the ink heads 41 are interposed between the third guards 62A in the main scanning direction Y. Each third guard 62A extends in the sub-scanning direction X. The third guards 62A are provided such that when viewed in the main scanning direction Y, a region where the third guards 62A are located overlaps with a region where the ink heads 41 are located. Thus, if the carriage 21 that is moving comes into contact with the recording medium 5 and causes the recording medium 5 to be caught under the carriage 21 in the event of a jam, each third guard 62A would function as a barrier so as to prevent the recording medium 5 from coming into contact with the ink heads 41. Consequently, the third guards 62A protect the ink heads 41 in the event of a jam.

The conveyor 30 will be described below. The conveyor 30 conveys the recording medium 5. The conveyor 30 includes a grit roller 31, the conveyance motor 32, the conveyance detector 33, and pinch rollers 34 (see FIGS. 1A and 1B). The grit roller 31 is a roller to convey the recording medium 5. The grit roller 31 is embedded in the platen 15 such that the upper surface of the grit roller 31 is exposed. The conveyance motor 32 is a driving source to rotate the grit roller 31. The conveyance detector 33 is provided to detect a distance by which the recording medium 5 is conveyed. Each pinch roller 34 faces the grit roller 31. The position of each pinch roller 34 in an up-down direction is adjustable in accordance with the thickness of the recording medium 5. The recording medium 5 is sandwiched between the grit roller 31 and the pinch rollers 34. The grit roller 31 and the pinch rollers 34 convey the recording medium 5 in the sub-scanning direction X, with the recording medium 5 sandwiched between the grit roller 31 and the pinch rollers 34.

The printing unit 40 discharges ink droplets onto the recording medium 5. The printing unit 40 includes the ink heads 41 and the head driver 42. Each ink head 41 is an inkjet print head including a large number of nozzles 41B to discharge ink. The head driver 42 is a driver to start and stop discharge of ink droplets from the nozzles 41B of each ink head 41. When each ink head 41 is a piezoelectric ink head, for example, the head driver 42 is a driver to drive a piezoelectric element. Each ink head 41 is mounted on the carriage 21. Thus, each ink head 41 moves in the main scanning direction Y in a reciprocating manner together with the carriage 21. The printing unit 40 further includes the ink amount detector 43 to detect the amount of ink remaining in an ink reservoir (not illustrated) in each ink head 41.

As illustrated in FIG. 2, each ink head 41 includes: a base (not illustrated); the nozzles 41B to discharge ink onto the recording medium 5; and the nozzle surface 41A provided with the nozzles 41B. The base of each ink head 41 defines the body of the ink head 41. The base of each ink head 41 is provided with the ink reservoir to store ink supplied thereto. Each nozzle surface 41A is defined by a metal plate. Each nozzle surface 41A faces the platen 15. As previously described, the lower portion of each ink head 41 is inserted through an associated one of the openings 612 such that the nozzle surface 41A of each ink head 41 is located below the facing surface 611 of the head-equipped frame 61.

In the present preferred embodiment, each nozzle surface 41A is defined by a thin metal plate. Thus, if the ink head 41 comes into contact with the recording medium 5 in the event of a jam, the nozzle surface 41A will be defective, resulting in a malfunction in the ink head 41. Accordingly, it is particularly preferable to prevent contact of the recording medium 5 with the ink heads 41. Providing the first guard 63A, the second guard 63B, and the third guards 62A is particularly effective in preventing contact of the recording medium 5 with the ink heads 41. Providing the first guard 63A, the second guard 63B, and the third guards 62A so as to protect the ink heads 41 is also effective, for example, when the nozzle surfaces 41A have high rigidity.

Figure 3:
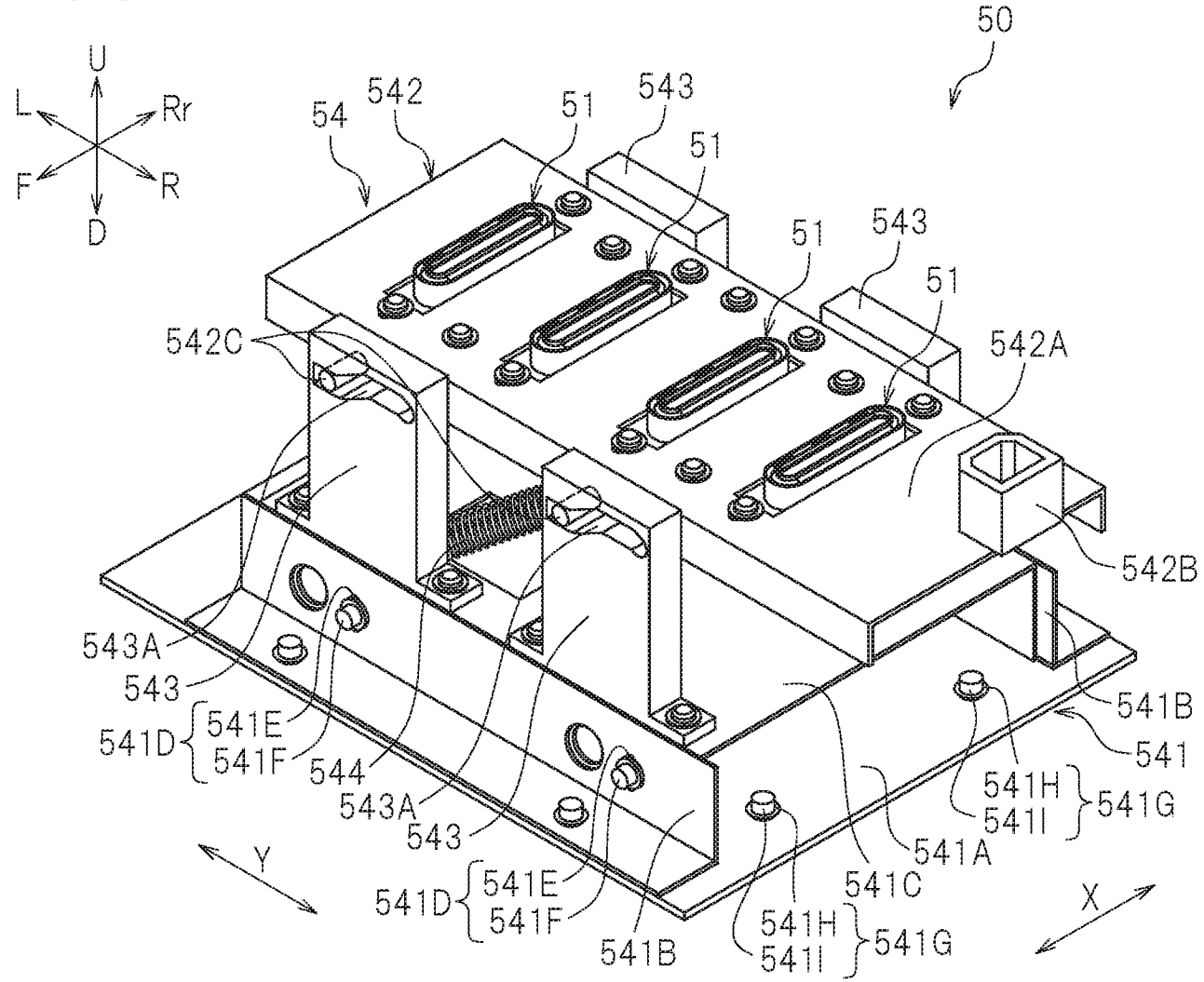
FIG. 3 is a perspective view of a cap unit according to the first preferred embodiment of the present invention.

The cap unit 50 will be described below. FIG. 3 is a perspective view of the cap unit 50. The cap unit 50 is used to perform cleaning of the ink heads 41. The cap unit 50 is disposed on an installation surface (not illustrated). The installation surface is provided in a casing of the printing apparatus 1 and located outward of a printing region to which the recording medium 5 is to be conveyed. In the present preferred embodiment, the cap unit 50 is disposed in the casing of the printing apparatus 1. The cap unit 50 includes the caps 51, the suction pump 52 (see FIG. 1B), and a frame 54. The suction pump 52 is not illustrated in FIG. 3. The suction pump 52 is an example of a suction device.

The caps 51 are detachably attachable to the ink heads 41 so as to cover the nozzle surfaces 41A of the ink heads 41 during cleaning of the ink heads 41. Attaching each cap 51 to the associated ink head 41 defines an enclosed space between each nozzle surface 41A and the associated cap 51. With each cap 51 in contact with the nozzle surface 41A of the associated ink head 41, the suction pump 52 sucks a fluid (e.g., air or ink) within the enclosed space so as to apply a negative pressure to each ink head 41. As a result, for example, foreign matter adhering to the nozzle surfaces 41A of the ink heads 41 and/or foreign matter clogging the nozzles 41B are sucked out.

The frame 54 supports the caps 51. The frame 54 is disposed below the carriage 21. The frame 54 moves the caps 51 so as to attach the caps 51 to the ink heads 41 during cleaning of the ink heads 41 and detach the caps 51 from the ink heads 41 after cleaning of the ink heads 41. The frame 54 includes a supporting frame 541, supports 543, the cap-equipped frame 542, and a coil spring 544.

The supporting frame 541 is secured to the casing of the printing apparatus 1. The supporting frame 541 supports the cap-equipped frame 542. The supporting frame 541 includes a bottom plate 541A, side plates 541B, a top plate 541C, vertical adjusters 541D, and horizontal adjusters 541G.

The bottom plate 541A supports the side plates 541B and the top plate 541C. The bottom plate 541A is secured to the installation surface for the cap unit 50. The bottom plate 541A is secured to the installation surface for the cap unit 50 through the horizontal adjusters 541G.

The horizontal adjusters 541G are provided to secure the bottom plate 541A to the installation surface for the cap unit 50 such that the bottom plate 541A is disposed at an appropriate horizontal position. The horizontal adjusters 541G are provided at four locations on the bottom plate 541A, for example. In other words, the bottom plate 541A is secured to the installation surface for the cap unit 50 at four locations, for example. The four horizontal adjusters 541G are required to be disposed such that the cap unit 50 is stably secured to the installation surface. The four horizontal adjusters 541G may be disposed such that the horizontal adjusters 541G are each located at a vertex of a quadrangle, for example. The quadrangle in this case is a rectangle, for example. The four horizontal adjusters 541G are preferably disposed away from each other and adjacent to the periphery of the bottom plate 541A such that the cap unit 50 is stably secured to the installation surface.

Each horizontal adjuster 541G includes an insertion hole 541H and a screw 541I that are provided in the bottom plate 541A. The bottom plate 541A is secured to the installation surface for the cap unit 50 with the screws 541I inserted through the insertion holes 541H. Thus, the bottom plate 541A is secured to the installation surface for the cap unit 50 such that the bottom plate 541A is located at an appropriate horizontal position.

The side plates 541B are securely disposed at two locations on the bottom plate 541A. The side plates 541B are located on the upstream side and the downstream side in the sub-scanning direction X. Each of the two side plates 541B is disposed such that each side plate 541B has a flat surface perpendicular or substantially perpendicular to the sub-scanning direction X.

The top plate 541C is disposed above the bottom plate 541A. The top plate 541C is sandwiched between the two side plates 541B. The top plate 541C is secured to the two side plates 541B through the vertical adjusters 541D. The vertical adjusters 541D are provided such that fine adjustments are made to the height and angle of the top plate 541C relative to the bottom plate 541A. The vertical adjusters 541D are provided at two locations on each of the two side plates 541B, for example. In other words, the top plate 541C is secured to the two side plates 541B at four locations, for example. Making fine adjustments to the height at which the top plate 541C is secured to the side plates 541B using the vertical adjusters 541D makes it possible to make fine adjustments to the height and horizontal angle of the top plate 541C relative to the bottom plate 541A.

Each vertical adjuster 541D includes an insertion hole 541E and a screw 541F that are provided in the associated side plate 541B. The insertion holes 541E are extended in the vertical direction (i.e., the up-down direction). The top plate 541C is secured to the side plates 541B with the screws 541F inserted through the insertion holes 541E. Because the insertion holes 541E are extended in the vertical direction, fine adjustments are made to the position of the top plate 541C secured to the side plates 541B with the screws 541F (i.e., the position of the top plate 541C relative to the side plates 541B in the vertical direction). This makes it possible to make fine adjustments to the height and horizontal angle of the top plate 541C relative to the bottom plate 541A.

The supports 543 are securely disposed at four locations on the top plate 541C. The supports 543 are arranged in a matrix with two rows and two columns in the main scanning direction Y and the sub-scanning direction X. Each of the supports 543 disposed at four locations on the top plate 541C is provided with a cam groove 543A. The cam grooves 543A have identical shapes or substantially identical shapes. Each cam groove 543A has a generally stepped shape when viewed in the sub-scanning direction X.

The cap-equipped frame 542 is equipped with the caps 51. The caps 51 are secured to the cap-equipped frame 542 at predetermined intervals in the main scanning direction Y. The cap-equipped frame 542 includes a facing surface 542A that faces the carriage 21 during cleaning and positioning of the ink heads 41. The facing surface 542A defines and functions as one of reference surfaces of the cap unit 50 during positioning. The cap-equipped frame 542 further includes an upwardly protruded lever 542B disposed on the right end of the facing surface 542A in the main scanning direction Y. The carriage 21 presses the lever 542B so as to move the cap-equipped frame 542 in the main scanning direction Y.

The cap-equipped frame 542 has a generally rectangular shape having two parallel sides extending in the sub-scanning direction X and two parallel sides extending in the main scanning direction Y. The cap-equipped frame 542 is disposed such that the cap-equipped frame 542 is interposed between the supports 543 in the sub-scanning direction X. The two parallel sides of the cap-equipped frame 542 extending in the main scanning direction Y are each provided with two slide pins 542C. The slide pins 542C are each in engagement with the cam groove 543A of the associated support 543, so that the cap-equipped frame 542 is supported by the supporting frame 541. The cap-equipped frame 542 is vertically or substantially vertically movable in accordance with movement of the slide pins 542C along the cam grooves 543A in the main scanning direction Y.

The coil spring 544 connects the supporting frame 541 to the cap-equipped frame 542. The cap-equipped frame 542 receives, from the coil spring 544, a force that urges the cap-equipped frame 542 to one side in the main scanning direction Y (i.e., a force that urges the cap-equipped frame 542 leftward in the present preferred embodiment). A vertically lower one of the ends of each cam groove 543A in the main scanning direction Y (i.e., the left end of each cam groove 543A in the main scanning direction Y in the present preferred embodiment) restricts movement of the associated slide pin 542C. Thus, at normal times, the cap-equipped frame 542 is stationary at its vertically lowest position relative to the supporting frame 541.

A method for performing positioning of each ink head and the associated cap 51 relative to each other will be described below. FIGS. 5A to 5D are schematic diagrams illustrating the method for performing positioning of each ink head 41 and the associated cap 51 relative to each other when viewed from the downstream side in the sub-scanning direction X. FIGS. 6A to 6C are schematic diagrams illustrating the method for performing positioning of each ink head 41 and the associated cap 51 relative to each other when viewed from above in the vertical direction. In FIGS. 6A to 6C, a positioning jig 55 (see FIG. 4) and the guard 63 are indicated by solid lines so as to focus attention on the positioning jig 55 and the guard 63. Positioning of each ink head 41 and the associated cap 51 relative to each other is performed by making adjustments to the position of each cap 51 with respect to the associated ink head 41 in the vertical direction and the horizontal direction (which includes the main scanning direction Y and the sub-scanning direction X). The method described below involves performing, in particular, positioning of the head-equipped frame 61 and the cap-equipped frame 542 relative to each other so as to perform positioning of each ink head 41 (which is secured to the head-equipped frame 61) and the associated cap 51 (which is secured to the cap-equipped frame 542) relative to each other. Positioning of each ink head 41 and the associated cap 51 relative to each other is performed during assembly of the printing apparatus 1.

When each cap 51 is brought into contact with the nozzle surface 41A of the associated ink head 41 so as to perform cleaning of the ink heads 41, an enclosed space has to be defined between each cap 51 and the associated nozzle surface 41A. If no enclosed space is defined between each cap 51 and the associated nozzle surface 41A owing to, for example, a gap therebetween, the suction pump 52 is unable to apply an appropriate negative pressure to the nozzles 41B. This makes it impossible to properly perform cleaning of the ink heads 41. For example, suppose that the facing surface 611 of the carriage 21 and the facing surface 542A of the cap-equipped frame 542 are not parallel to each other in the horizontal direction, or each cap 51 is located too far away from the associated ink head 41 in the vertical direction. In such a case, no enclosed space may be defined between each cap 51 and the associated nozzle surface 41A. To prevent such a problem in performing cleaning of the ink heads 41, accurate positioning of each cap 51 relative to the associated ink head 41 must be performed in the horizontal direction and the vertical direction during assembly of the printing apparatus 1.

The following description discusses the method for performing positioning of each ink head 41 and the associated cap 51 relative to each other by making adjustments to the position of the cap-equipped frame 542 relative to the head-equipped frame 61 in the horizontal direction and the vertical direction.

Figure 5A:
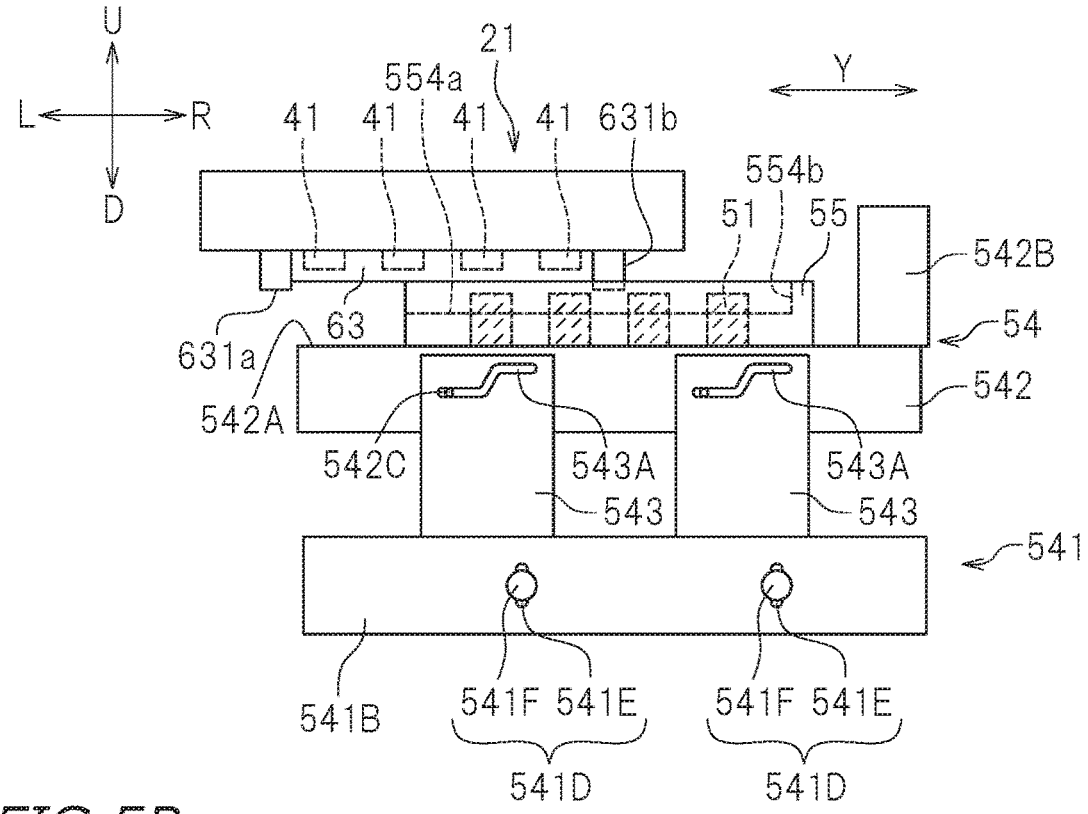
FIG. 5A is a schematic diagram illustrating a positioning method.
Figure 6A:
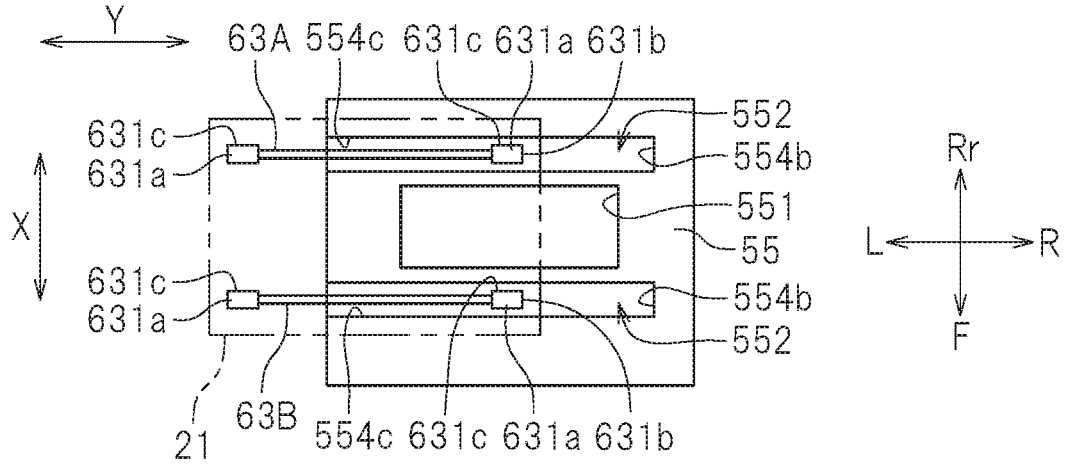
FIG. 6A is a schematic diagram illustrating the positioning method.
Figure 6B:
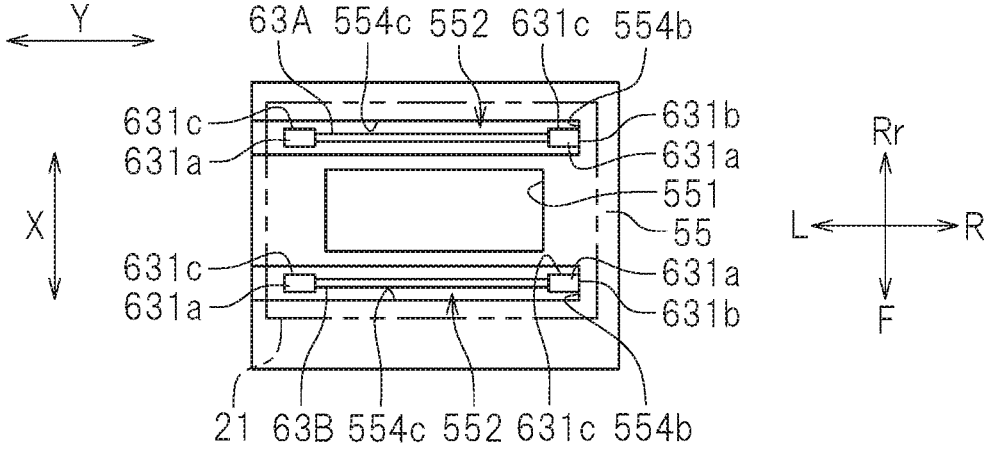
FIG. 6B is a schematic diagram illustrating the positioning method.
Figure 6C:
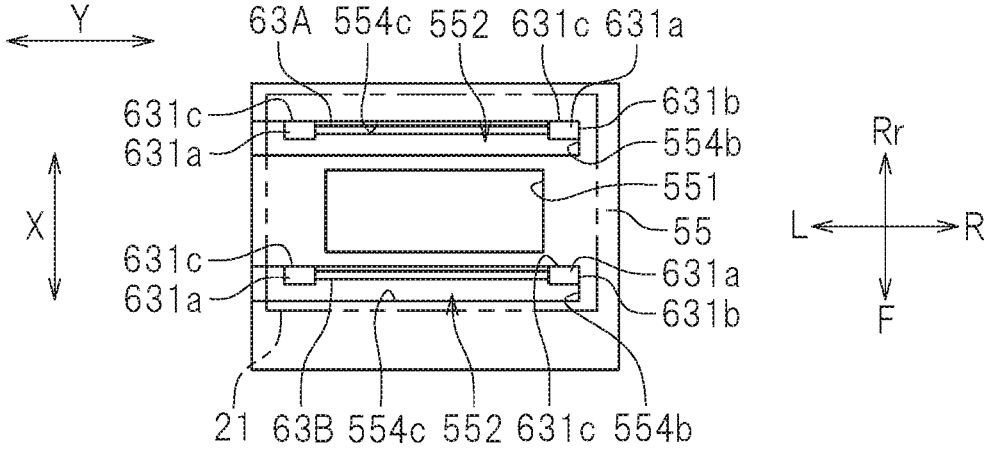
FIG. 6C is a schematic diagram illustrating the positioning method.

FIGS. 5A and 6A are schematic diagrams each illustrating the carriage 21 and the cap unit 50 when the carriage 21 is moving rightward in the main scanning direction Y. At this point in time, the cap-equipped frame 542 is located at the lowest position within its vertically movable range. In other words, at this point in time, the difference in vertical height between each ink head 41 and the cap-equipped frame 542 is at the maximum. This means that the ink heads 41 are located farthest away from the cap-equipped frame 542 in the vertical direction.

Figure 4:
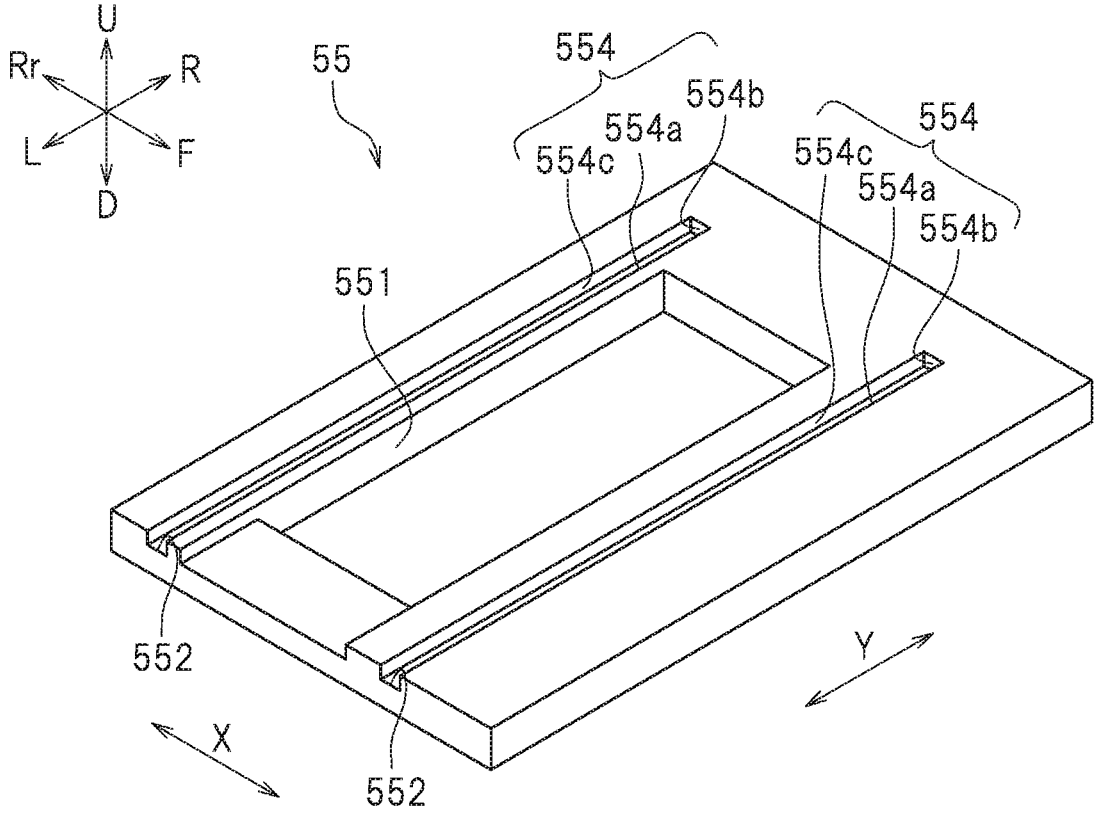
FIG. 4 is a perspective view of a positioning jig according to the first preferred embodiment of the present invention.

Positioning of each ink head 41 and the associated cap 51 relative to each other involves disposing the positioning jig 55 on the facing surface 542A of the cap-equipped frame 542. FIG. 4 is a perspective view of the positioning jig 55. The positioning jig 55 is a plate member attachable to and detachable from the cap-equipped frame 542.

With the positioning jig 55 disposed on the cap-equipped frame 542, the lengthwise direction of the positioning jig 55 corresponds to the main scanning direction Y, the widthwise direction of the positioning jig 55 corresponds to the sub-scanning direction X, and the height direction of the positioning jig 55 corresponds to the up-down direction.

The positioning jig 55 is provided with an opening 551 and grooves 552. The opening 551 is provided in a substantially central portion of the positioning jig 55. The opening 551 passes through the positioning jig 55 in the up-down direction. The opening 551 has a rectangular or substantially rectangular shape.

The grooves 552 are provided at two locations on the positioning jig 55. The grooves 552 each extend in the main scanning direction Y. The two grooves 552 are disposed such that the opening 551 is interposed between the groove 552 located on the upstream side in the sub-scanning direction X and the groove 552 located on the downstream side in the sub-scanning direction X. A first end of each of the two grooves 552 (e.g., the left end of each of the two grooves 552 in the present preferred embodiment) reaches a first lateral surface of the positioning jig 55 (e.g., the left lateral surface of the positioning jig 55 in the present preferred embodiment). A second end of each of the two grooves 552 (e.g., the right end of each of the two grooves 552 in the present preferred embodiment) does not reach a second lateral surface of the positioning jig 55 (e.g., the right lateral surface of the positioning jig 55 in the present preferred embodiment) opposite to the first lateral surface of the positioning jig 55.

The positioning jig 55 includes abutment surfaces 554. Each of the abutment surfaces 554 defines an associated one of the grooves 552. Each abutment surface 554 defines and functions as a reference surface of the cap unit 50 during positioning. Each abutment surface 554 includes a vertical direction abutment surface 554*a*, a main scanning direction abutment surface 554*b*, and sub-scanning direction abutment surfaces 554*c*.

Each vertical direction abutment surface 554*a* defines and functions as a reference surface of the cap unit 50 in the vertical direction during positioning. Each vertical direction abutment surface 554*a* is equivalent to a bottom surface included in the abutment surface 554 that defines the associated groove 552. With the positioning jig 55 disposed on the cap-equipped frame 542, each vertical direction abutment surface 554*a* is a flat surface perpendicular or substantially perpendicular to the vertical direction.

Each main scanning direction abutment surface 554*b* defines and functions as a reference surface of the cap unit 50 in the main scanning direction Y during positioning. Each main scanning direction abutment surface 554*b* is provided on only one of the ends of the associated groove 552 in the main scanning direction Y. With the positioning jig 55 disposed on the cap-equipped frame 542, each main scanning direction abutment surface 554*b* is a flat surface perpendicular or substantially perpendicular to the main scanning direction Y.

Each sub-scanning direction abutment surface 554*c* defines and functions as a reference surface of the cap unit 50 in the sub-scanning direction X during positioning. With the positioning jig 55 disposed on the cap-equipped frame 542, each sub-scanning direction abutment surface 554*c* is a flat surface perpendicular or substantially perpendicular to the sub-scanning direction X. The sub-scanning direction abutment surfaces 554*c* are provided at two locations for each of the grooves 552, for example. The sub-scanning direction abutment surfaces 554*c* are located on the upstream side and the downstream side in the sub-scanning direction X for each of the grooves 552.

Referring to FIGS. 5A and 6A, when the carriage 21 moves rightward in the main scanning direction Y (i.e., when the carriage 21 moves from the printing region to a position where the ink heads 41 are placed on standby), the first guard 63A and the second guard 63B provided on the carriage 21 each move along the associated groove 552. Further rightward movement of the carriage 21 in the main scanning direction Y brings the main scanning direction reference surfaces 631*b* of the first guard 63A and the second guard 63B into contact with the main scanning direction abutment surfaces 554*b* of the positioning jig 55 (see FIGS. 5B and 6B). This determines the position of the cap unit 50 with respect to the carriage 21 in the main scanning direction Y. More specifically, performing this step effects positioning of the cap-equipped frame 542 with respect to the head-equipped frame 61 in the main scanning direction Y.

Figure 5B:
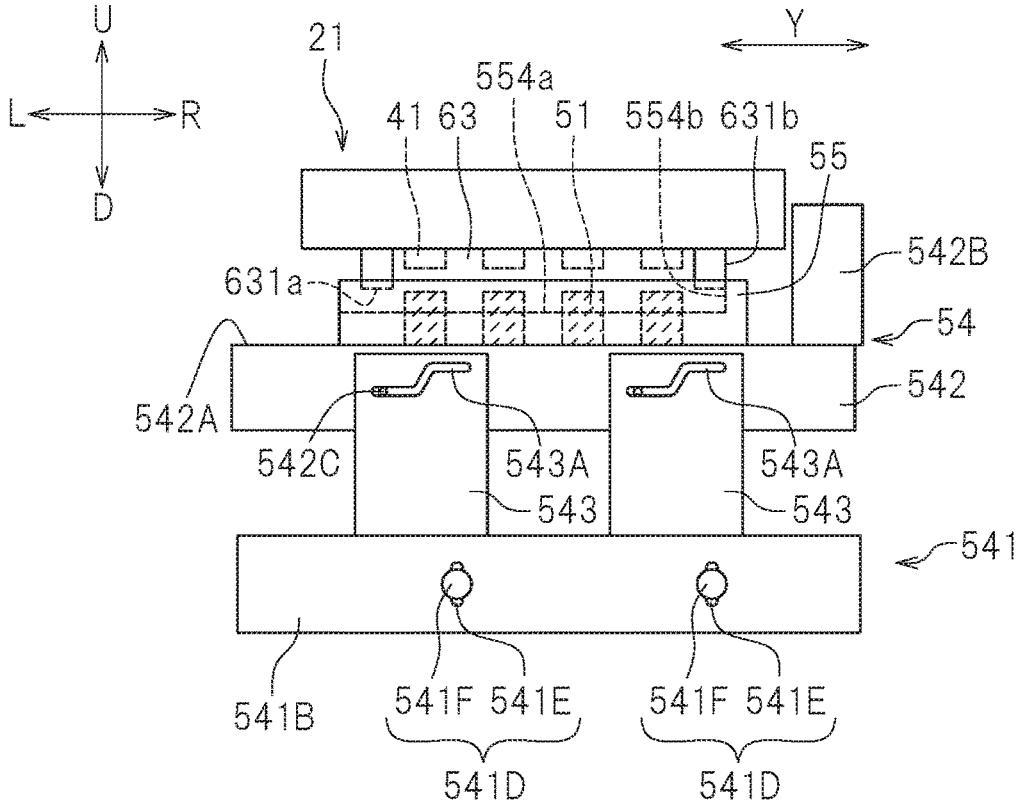
FIG. 5B is a schematic diagram illustrating the positioning method.

Suppose that the carriage 21 moves further rightward in the main scanning direction Y from the state illustrated in FIGS. 5B and 6B. In this case, while the position of the cap-equipped frame 542 relative to the carriage 21 in the main scanning direction Y is maintained, the cap-equipped frame 542 moves rightward in the main scanning direction Y, and the slide pins 542C move along the cam grooves 543A, resulting in upward movement of the cap-equipped frame 542.

Figure 5C:
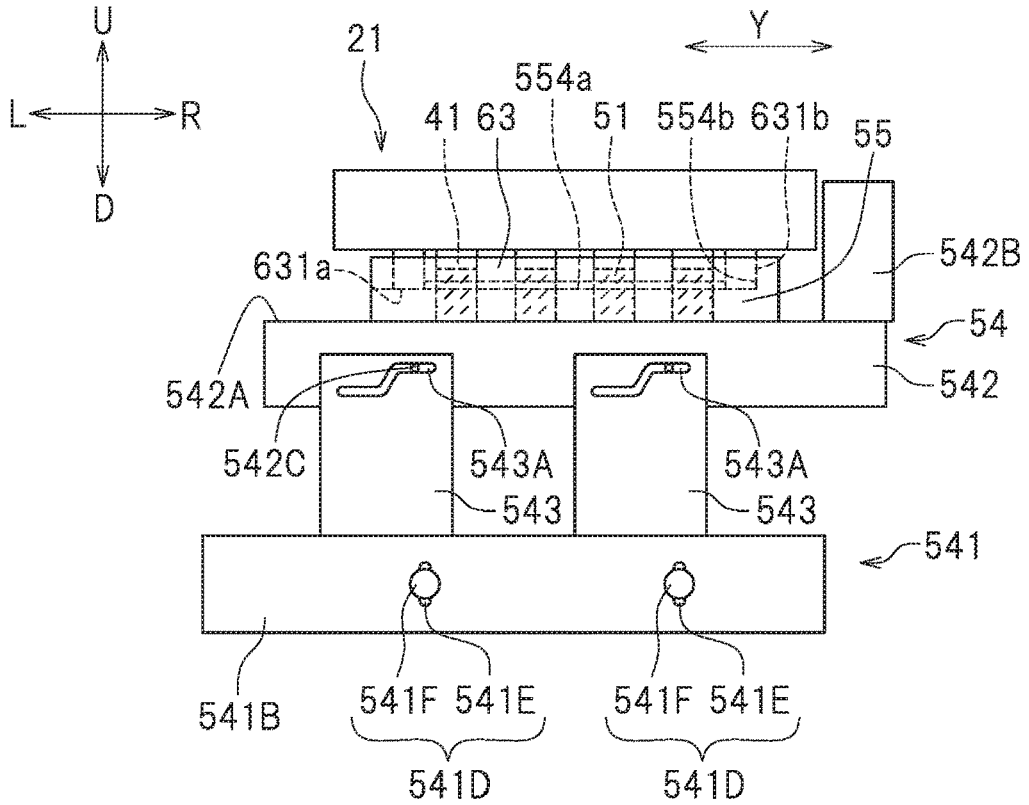
FIG. 5C is a schematic diagram illustrating the positioning method.
Figure 5D:
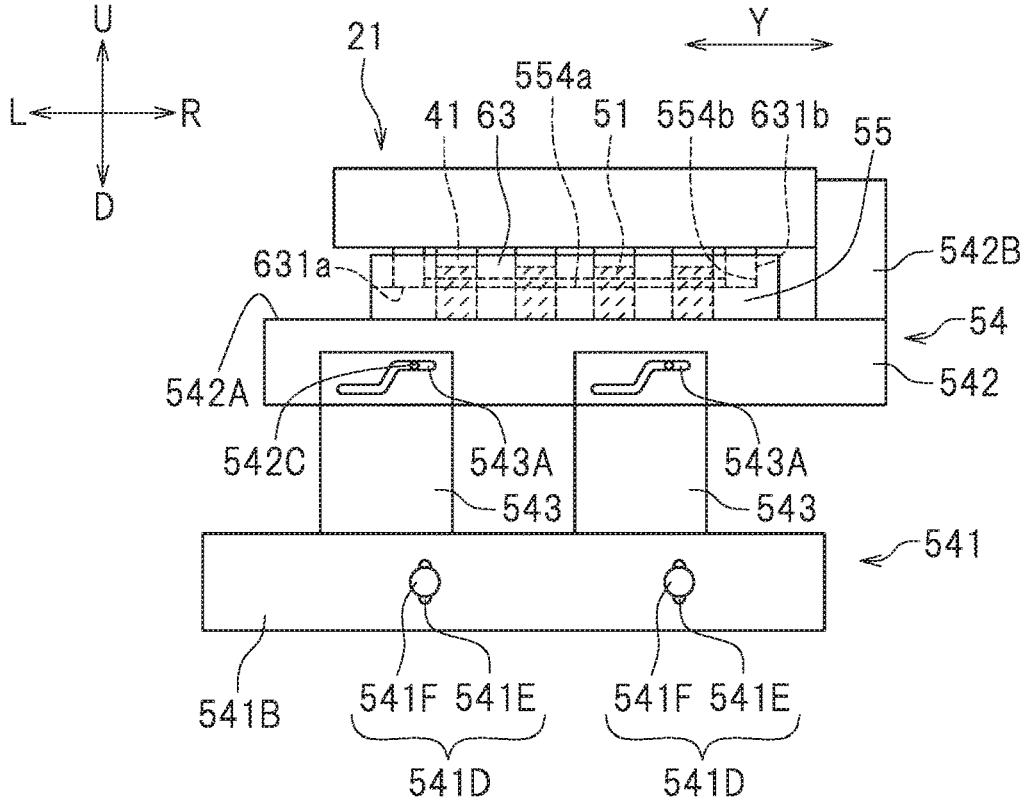
FIG. 5D is a schematic diagram illustrating the positioning method.

When the carriage 21 moves to the rightmost position within its movable range in the main scanning direction Y from the state illustrated in FIGS. 5B and 6B, the cap-equipped frame 542 reaches the uppermost position within its movable range in the vertical direction (see FIG. 5C).

In this state, positioning of each ink head 41 and the associated cap 51 relative to each other in the sub-scanning direction X is performed in a manner described below. More specifically, positioning of the cap-equipped frame 542 with respect to the head-equipped frame 61 in the sub-scanning direction X is performed in the manner described below.

Positioning of each ink head 41 and the associated cap 51 relative to each other in the sub-scanning direction X first involves performing positioning of the cap-equipped frame 542 and the head-equipped frame 61 relative to each other in the sub-scanning direction X. Thus, the position of the cap-equipped frame 542 in the sub-scanning direction X is determined such that the sub-scanning direction reference surfaces 631*c* of the first guard 63A and the second guard 63B are in contact with the sub-scanning direction abutment surfaces 554*c* of the positioning jig 55 (see FIG. 6C). In the present preferred embodiment, the position of the cap-equipped frame 542 in the sub-scanning direction X is determined such that the sub-scanning direction reference surfaces 631*c* on the upstream side in the sub-scanning direction X are in contact with the sub-scanning direction abutment surfaces 554*c* on the upstream side in the sub-scanning direction X. After the position of the cap-equipped frame 542 in the sub-scanning direction X is determined, the position of the cap-equipped frame 542 in the sub-scanning direction X is fixed by the horizontal adjusters 541G. Performing positioning in the main scanning direction Y and the sub-scanning direction X as described above completes positioning of each ink head 41 and the associated cap 51 relative to each other in the horizontal direction. Thus, the nozzle surface 41A of each ink head 41 and the associated cap 51 face each other.

Assuming that each reference surface 631 includes high-precision flat surfaces, positioning of each ink head 41 and the associated cap 51 relative to each other in the horizontal direction (which may hereinafter be simply referred to as "horizontal positioning") theoretically only requires determining the positions of one of the main scanning direction reference surfaces 631*b* and one of the sub-scanning direction reference surfaces 631*c* of the carriage 21. The main scanning direction reference surfaces 631*b* and the sub-scanning direction reference surfaces 631*c*, however, are smaller in area than the cap unit 50. This actually makes it difficult to perform horizontal positioning using only one of the main scanning direction reference surfaces 631*b* and one of the sub-scanning direction reference surfaces 631*c* of the carriage 21. Thus, horizontal positioning is preferably performed using at least three of the reference surfaces provided on the carriage 21 and the cap unit 50. In one example, horizontal positioning may be performed such that two of the main scanning direction reference surfaces 631*b* of the carriage 21 come into contact with the main scanning direction abutment surfaces 554*b* of the positioning jig 55 and at least one of the sub-scanning direction reference surfaces 631*c* of the carriage 21 comes into contact with an associated one of the sub-scanning direction abutment surfaces 554*c* of the positioning jig 55.

The next step involves performing positioning of the cap-equipped frame 542 and the head-equipped frame 61 relative to each other in the vertically direction. In this step, fine adjustments are made to the height of the cap-equipped frame 542 and the angle of the cap-equipped frame 542 relative to the horizontal direction such that the vertical direction reference surfaces 631*a* of the head-equipped frame 61 come into contact with the vertical direction abutment surfaces 554*a* of the positioning jig 55. Such fine adjustments are preferably made using the vertical adjusters 541D of the supporting frame 541. This effects positioning of the cap-equipped frame 542 and the head-equipped frame 61 relative to each other in the vertical direction. Accordingly, the nozzle surface 41A of each ink head 41 and the associated cap 51 are in contact with each other with a suitable pressing force.

In this state, the lever 542B is pressed against the carriage 21. In this preferred embodiment, the lever 542B is pressed against the carriage 21 by moving the lever 542B leftward. With the lever 542B pressed against the carriage 21, the lever 542B is secured to the cap-equipped frame 542 with a securing member such as a screw (see FIG. 5D). Thus, if the positioning jig 55 is detached from the cap-equipped frame 542, the position of the cap-equipped frame 542 relative to the head-equipped frame 61 in the main scanning direction Y would be suitably maintained in a range in which the carriage 21 and the caps 51 move together, with the carriage 21 in contact with the lever 542B. Completing positioning of the head-equipped frame 61 and the cap-equipped frame 542 relative to each other by performing the above-described method effects positioning of each ink head 41 (which is secured to the head-equipped frame 61) and the associated cap 51 (which is secured to the cap-equipped frame 542) relative to each other.

After completion of positioning, the carriage 21 is moved leftward in the main scanning direction Y, so that the carriage 21 moves away from the caps 51. The positioning jig 55 is then detached from the cap-equipped frame 542. The relative positions of each ink head 41 and the associated cap 51 determined by positioning are maintainable during cleaning to be performed afterward.

Figure 7:
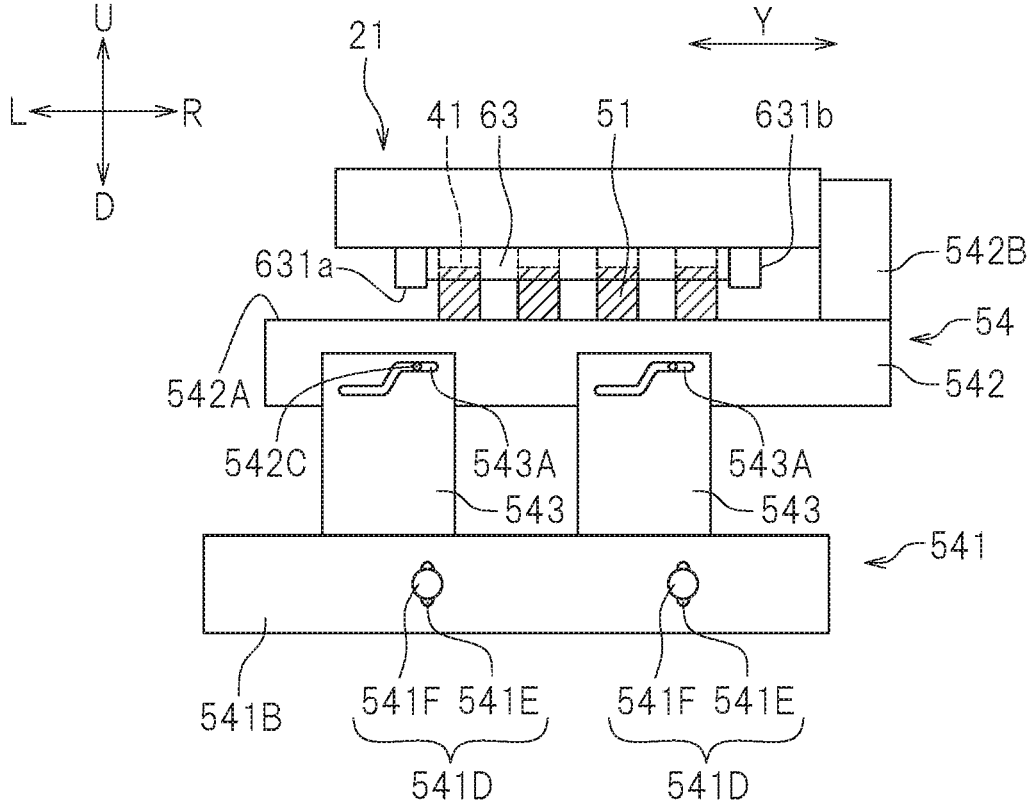
FIG. 7 is a schematic diagram illustrating how the ink heads are cleaned.

The following description discusses how the ink heads 41 are cleaned. FIG. 7 is a schematic diagram illustrating how the ink heads 41 are cleaned. The ink heads 41 are cleaned in the state illustrated in FIG. 7. In this state, each cap 51 is in contact with the nozzle surface 41A of the associated ink head 41. The positioning jig 55 is not used during cleaning. Because the above-described positioning operation is already completed in the printing apparatus 1, each cap 51 and the nozzle surface 41A of the associated ink head 41 are in contact with each other with a suitable pressing force during cleaning. In this state, the suction pump 52 sucks a fluid within an enclosed space defined between each cap 51 and the associated nozzle surface 41A. As a result, for example, foreign matter adhering to the nozzle surfaces 41A of the ink heads 41 and/or foreign matter clogging the nozzles 41B are sucked out.

The guard 63 of the printing apparatus 1 according to the present preferred embodiment described above is provided with the reference surfaces 631 to position each ink head 41 and the associated cap 51 relative to each other. The reference surfaces 631 are disposed in a space for the guard 63. This makes it unnecessary to leave a space for the guard 63 and a space for the reference surfaces 631 separately on the facing surface 611 of the carriage 21. Thus, the present preferred embodiment achieves space saving for the facing surface 611 of the carriage 21 and reduces the number of components.

In the present preferred embodiment, each reference surface 631 includes the vertical direction reference surface 631*a* to position of each ink head 41 and the associated cap 51 relative to each other in the vertical direction; the main scanning direction reference surface 631*b* to position each ink head 41 and the associated cap 51 relative to each other in the main scanning direction Y; and the sub-scanning direction reference surfaces 631*c* to position each ink head 41 and the associated cap 51 relative to each other in the sub-scanning direction X. This enables positioning of each cap 51 relative to the associated ink head 41 in the vertical direction, the main scanning direction Y, and the sub-scanning direction X.

In the present preferred embodiment, the vertical direction reference surface 631*a*, the main scanning direction reference surface 631*b*, and the sub-scanning direction reference surface 631*c* are perpendicular or substantially perpendicular to each other. Thus, positioning of each cap 51 relative to the associated ink head 41 in the vertical direction, the main scanning direction Y, and the sub-scanning direction X is performed with higher reliability.

In the present preferred embodiment, the reference surfaces 631 are provided on the both ends of the first guard 63A in the main scanning direction Y and the both ends of the second guard 63B in the main scanning direction Y. This prevents the recording medium 5 from not only coming closer to the ink heads 41 from the upstream side or the downstream side in the sub-scanning direction X but also coming closer to the ink heads 41 in the main scanning direction Y in the event of a jam.

In the present preferred embodiment, the guard 63 is provided with the additional surface 631*x* located above the vertical direction reference surfaces 631*a*. This increases mechanical strength of the guard 63.

In the present preferred embodiment, the reference surfaces 631 are provided on the guard 63 by cutting. This enables the vertical direction reference surfaces 631*a* to have flatness necessary to position of each ink head 41 and the associated cap 51 relative to each other.

In the present preferred embodiment, the length of each reference surface 631 in the sub-scanning direction X is longer than the length of the second portion 63Y of the guard 63 in the sub-scanning direction X. This increases mechanical strength of the guard 63.

In the present preferred embodiment, the guard 63 is integral with the facing surface 611. This makes it unnecessary to provide an additional component for the guard 63. Thus, the present preferred embodiment reduces the number of components and simplifies the structure of the carriage 21.

Second Preferred Embodiment

Figure 8:
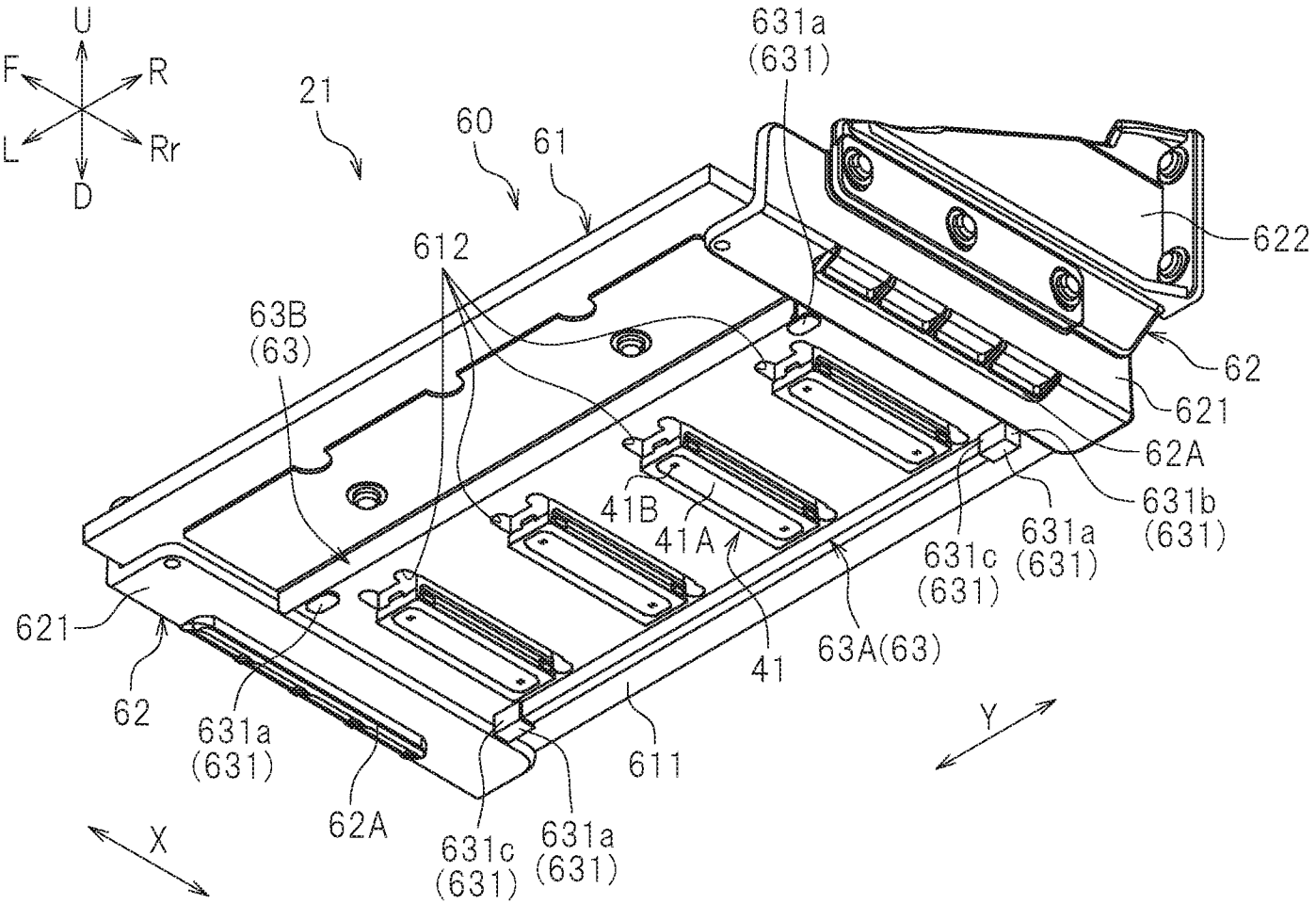
FIG. 8 is a perspective view of a carriage and ink heads according to a second preferred embodiment of the present invention.

A printing apparatus according to a second preferred embodiment of the present invention will be described. FIG. 8 is a perspective view of the carriage 21 and the ink heads 41 when viewed from obliquely below.

The printing apparatus according to the second preferred embodiment differs from the printing apparatus 1 according to the first preferred embodiment in that two of the vertical direction reference surfaces 631*a* are provided independently of the second guard 63B. The two vertical direction reference surfaces 631*a* independent of the second guard 63B will be referred to as "independent vertical direction reference surfaces 631*a*". The independent vertical direction reference surfaces 631*a* are integral with the facing surface 611 of the head-equipped frame 61. The independent vertical direction reference surfaces 631*a* are smaller in height from the facing surface 611 than the vertical direction reference surfaces 631*a* of the first guard 63A. The vertical direction reference surfaces 631*a* may be independent of the guard 63 and integral with the facing surface 611 of the head-equipped frame 61 in this manner. All of the vertical direction reference surfaces 631*a* do not have to be equal in height from the facing surface 611. Accordingly, the vertical direction abutment surfaces 554*a* of the positioning jig 55 to be used in the second preferred embodiment are configured to come into contact with the vertical direction reference surfaces 631*a* different in height from the facing surface 611 of the head-equipped frame 61.

The head-equipped frame 61 of the printing apparatus according to the second preferred embodiment differs in structure from the head-equipped frame 61 of the printing apparatus 1 according to the first preferred embodiment. Specifically, the second guard 63B of the printing apparatus 1 according to the first preferred embodiment is integral with the facing surface 611 of the head-equipped frame 61, but the second guard 63B of the printing apparatus according to the second preferred embodiment is a component separate from the head-equipped frame 61. Thus, when the guard 63 includes a plurality of sub-guards (e.g., the first guard 63A and the second guard 63B), at least one of the sub-guards may be integral with the facing surface 611 of the head-equipped frame 61.

In such a case, at least three of the main scanning direction reference surfaces 631*b* and the sub-scanning direction reference surfaces 631*c* of the first guard 63A integral with the facing surface 611 of the head-equipped frame 61 are preferably used to perform positioning of the cap-equipped frame 542 relative to the head-equipped frame 61 in the horizontal direction. In one example, horizontal positioning may be performed such that two of the main scanning direction reference surfaces 631*b* of the carriage 21 come into contact with the main scanning direction abutment surfaces 554*b* of the positioning jig 55 and at least one of the sub-scanning direction reference surfaces 631*c* of the carriage 21 comes into contact with an associated one of the sub-scanning direction abutment surfaces 554*c* of the positioning jig 55. After horizontal positioning, positioning of the cap-equipped frame 542 and the head-equipped frame 61 relative to each other in the vertical direction may be performed similarly to the first preferred embodiment. Fine adjustments are made to the height of the cap-equipped frame 542 and the angle of the cap-equipped frame 542 relative to the horizontal direction such that the vertical direction reference surfaces 631*a* of the head-equipped frame 61 come into contact with the vertical direction abutment surfaces 554*a* of the positioning jig 55.

Suppose that positioning of the cap-equipped frame 542 with respect to the head-equipped frame 61 is performed in addition to the above-described operations. In this case, a positioning pin (not illustrated) may be provided on the positioning jig 55, and a connection pin hole (not illustrated) may be provided in the head-equipped frame 61 such that the positioning pin is fitted into the connection pin hole. Thus, positioning of the cap-equipped frame 542 relative to the head-equipped frame 61 may be performed by inserting the positioning pin into the connection pin hole.

Other Preferred Embodiments

The above preferred embodiments are provided by way of example and are not intended to limit the scope of the present invention. The features of the above preferred embodiments may be used in any suitable combination. Various omissions, substitutions, and modifications may be made to the present invention without departing from the spirit of the present invention. The above preferred embodiments and variations thereof are included in the scope and spirit of the present invention and also included in the scope of the present invention defined in the claims and equivalents thereof.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principles of the present invention. These preferred embodiments are provided with the understanding that they are not intended to limit the present invention to the preferred embodiments described in the specification and/or shown in the drawings. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or used during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A printing apparatus comprising:

a platen on which a recording medium is to be placed, the platen extending in a main scanning direction;

a conveyor to convey the recording medium in a sub-scanning direction perpendicular or substantially perpendicular to the main scanning direction;

an ink head including a nozzle to discharge ink onto the recording medium and a nozzle surface provided with the nozzle;

a carriage equipped with the ink head, disposed above the platen, and movable in the main scanning direction;

a cap detachably attachable to the ink head so as to cover the nozzle surface, and defining an enclosed space between the cap and the nozzle surface when the cap is attached to the ink head;

a suction device to suck a fluid within the enclosed space; and a cap-equipped frame equipped with the cap, the cap-equipped frame being disposed below the carriage; wherein the carriage includes:

a facing surface that faces the platen; and a guard provided on the facing surface and protruding downward;

the guard is provided with a reference surface that positions the ink head and the cap relative to each other; and a jig is disposed on the cap-equipped frame to come into contact with the reference surface of the guard to perform positioning of the ink head and the cap relative to each other.

2. The printing apparatus according to claim 1, wherein the reference surface is defined by a cut portion of the guard.

3. The printing apparatus according to claim 1, wherein the guard includes:

a first portion provided with the reference surface; and a second portion disposed laterally of the reference surface; wherein a length of the reference surface in the sub-scanning direction is longer than a length of the second portion of the guard in the sub-scanning direction.

4. The printing apparatus according to claim 1, wherein the guard is integral with the facing surface.

5. A printing apparatus comprising:

a platen on which a recording medium is to be placed, the platen extending in a main scanning direction;

a conveyor to convey the recording medium in a sub-scanning direction perpendicular or substantially perpendicular to the main scanning direction;

an ink head including a nozzle to discharge ink onto the recording medium and a nozzle surface provided with the nozzle;

a carriage equipped with the ink head, disposed above the platen, and movable in the main scanning direction;

a cap detachably attachable to the ink head so as to cover the nozzle surface, and defining an enclosed space between the cap and the nozzle surface when the cap is attached to the ink head; and a suction device to suck a fluid within the enclosed space; wherein the carriage includes:

a facing surface that faces the platen; and a guard provided on the facing surface and protruding downward;

the guard is provided with a reference surface that positions the ink head and the cap relative to each other;

the reference surface includes:

a vertical direction reference surface that positions the ink head and the cap relative to each other in a vertical direction;

a main scanning direction reference surface that positions the ink head and the cap relative to each other in the main scanning direction; and a sub-scanning direction reference surface that positions the ink head and the cap relative to each other in the sub-scanning direction.

6. The printing apparatus according to claim 5, wherein the vertical direction reference surface, the main scanning direction reference surface, and the sub-scanning direction reference surface are perpendicular or substantially perpendicular to each other.

7. The printing apparatus according to claim 5, wherein the guard is provided with an additional surface disposed above the vertical direction reference surface.

8. A printing apparatus comprising:

a platen on which a recording medium is to be placed, the platen extending in a main scanning direction;

a conveyor to convey the recording medium in a sub-scanning direction perpendicular or substantially perpendicular to the main scanning direction;

an ink head including a nozzle to discharge ink onto the recording medium and a nozzle surface provided with the nozzle;

a carriage equipped with the ink head, disposed above the platen, and movable in the main scanning direction;

a cap detachably attachable to the ink head so as to cover the nozzle surface, and defining an enclosed space between the cap and the nozzle surface when the cap is attached to the ink head; and a suction device to suck a fluid within the enclosed space; wherein the carriage includes:

a facing surface that faces the platen; and a guard provided on the facing surface and protruding downward;

the guard is provided with a reference surface that positions the ink head and the cap relative to each other;

the guard includes:

a first guard extending in the main scanning direction and disposed upstream of the ink head in the sub-scanning direction; and a second guard extending in the main scanning direction and disposed downstream of the ink head in the sub-scanning direction; and the reference surface is provided on both ends of the first guard in the main scanning direction and both ends of the second guard in the main scanning direction.

* * * * *